United States Patent [19]

Grethe et al.

[11] Patent Number: 4,644,879

[45] Date of Patent: Feb. 24, 1987

[54] METHOD AND ANNULAR BURNER FOR SPRAYING AQUEOUS ADDITIVE SUSPENSION IN THE CENTRAL PORTION OF AN ANNULAR BURNER

[75] Inventors: Klaus Grethe, Gummersbach; Ralf Hülsen, Leverkusen; Walter Thielen, Gummersbach, all of Fed. Rep. of Germany

[73] Assignee: L. & C. Steinmüller GmbH, Gummersbach, Fed. Rep. of Germany

[21] Appl. No.: 801,010

[22] Filed: Nov. 22, 1985

[30] Foreign Application Priority Data

Dec. 6, 1984 [DE] Fed. Rep. of Germany ..... 3444469

[51] Int. Cl.[4] ..... F23B 7/00

[52] U.S. Cl. ..... 110/343; 110/264; 110/347; 431/4

[58] Field of Search ..... 110/264, 263, 347, 342, 110/343; 431/4, 8, 9; 423/210; 239/424, 425

[56] References Cited

U.S. PATENT DOCUMENTS

| | | | |
|---|---|---|---|
| 3,729,285 | 4/1973 | Schwedersky | 431/8 |
| 3,809,523 | 5/1974 | Varekamp | 431/4 |
| 4,381,718 | 5/1983 | Carver et al. | 110/342 X |
| 4,412,811 | 11/1983 | Pedrosa et al. | 431/4 X |
| 4,492,171 | 1/1985 | Brashears et al. | 110/264 X |

*Primary Examiner*—Edward G. Favors
*Attorney, Agent, or Firm*—Becker & Becker, Inc.

[57] ABSTRACT

A method and annular burner for binding sulfur and other impurities during the combustion of fuels that contain such impurities. The fuel is burned in an annular burner flame that has an internal recirculation zone. An additive in the form of an aqueous suspension is sprayed into the combustion chamber via at least one two-component atomizing nozzle, and the additive is mixed with the gases of the flame under optimum reaction conditions. In order to enable a particularly favorable binding of noxious material, an atomizing nozzle for the additive is disposed in the central portion of the annular burner, and the additive is sprayed as an external mixture, via the atomizing nozzle, along the longitudinal axis of the burner flame, as a fine or narrow stream, through the internal recirculation zone and into the flame. The flow pulse and the angle of dispersion of the additive suspension stream are selected in such a way that the additive suspension is not atomized until it reaches the optimum reaction region of the flame. The annular burner has at least one atomizing nozzle associated therewith for atomizing aqueous additive suspension. The additive atomizing nozzle is also embodied as a two-component nozzle having external mixing, and is disposed in the central portion of the annular burner.

8 Claims, 3 Drawing Figures

METHOD AND ANNULAR BURNER FOR SPRAYING AQUEOUS ADDITIVE SUSPENSION IN THE CENTRAL PORTION OF AN ANNULAR BURNER

BACKGROUND OF THE INVENTION

1. Field of the Invention

The present invention relates to a method of binding sulfur and other impurities during the combustion of fuels that contain such impurities. The fuel is burned in an annular burner flame that has an internal recirculation zone. An additive in the form of an aqueous suspension is sprayed into the combustion chamber via at least one two-component atomizing nozzle, and the additive is mixed with the gases of the flame under optimum reaction conditions. The present invention also relates to an annular burner for carrying out such a method, with at least one two-component atomizing nozzle being associated with the burner for introducing an aqueous additive suspension into the region of the flame.

2. Description of the Prior Art

A method of the aforementioned general type is known from U.S. Pat. No. 4,331,638, Michelfelder, dated Apr. 3, 1984, which belongs to the assignee of the present application. With this known method, the additive is injected into the combustion chamber via a number of nozzles distributed about the periphery of the burner. This forms a mist that surrounds the burner flame, with the additive diffusing into the flame from the mist.

German Offenlegungsschrift No. 19 02 504 discloses a method where the additive, in the form of an aqueous suspension, is sprayed into the burner flame at right angles to the blast of the flame. This leads to relatively unfavorable reaction conditions for the binding of $SO_2$. In particular, the mixing rate required for a high degree of binding is not achieved in the flame temperature range that is favorable for the binding reactions.

U.S. Pat. No. 4,440,100 Michelfelder et al dated Apr. 3, 1984, which also belongs to the assignee of the present application, discloses injecting into the combustion chamber, from below, and at specified locations independent of the burner, additives in the form of pulverous materials, such as calcium carbonate, magnesium carbonate, dolomite, and reactive oxide and hydroxide compounds. In this known method, the additive is first introduced into recirculation flows that are within the system and are closed, and due to locally different pressure conditions in the combustion chamber are formed in the latter below the burner.

An object of the present invention is to provide a method, as well as an annular burner for carrying out this method, whereby it is possible to achieve a particularly favorable binding of noxious materials.

BRIEF DESCRIPTION OF THE DRAWINGS

This object, and other objects and advantages of the present invention, will appear more clearly from the following specification in conjunction with the schematic drawings, in which.

SUMMARY OF THE INVENTION

Figure 1:
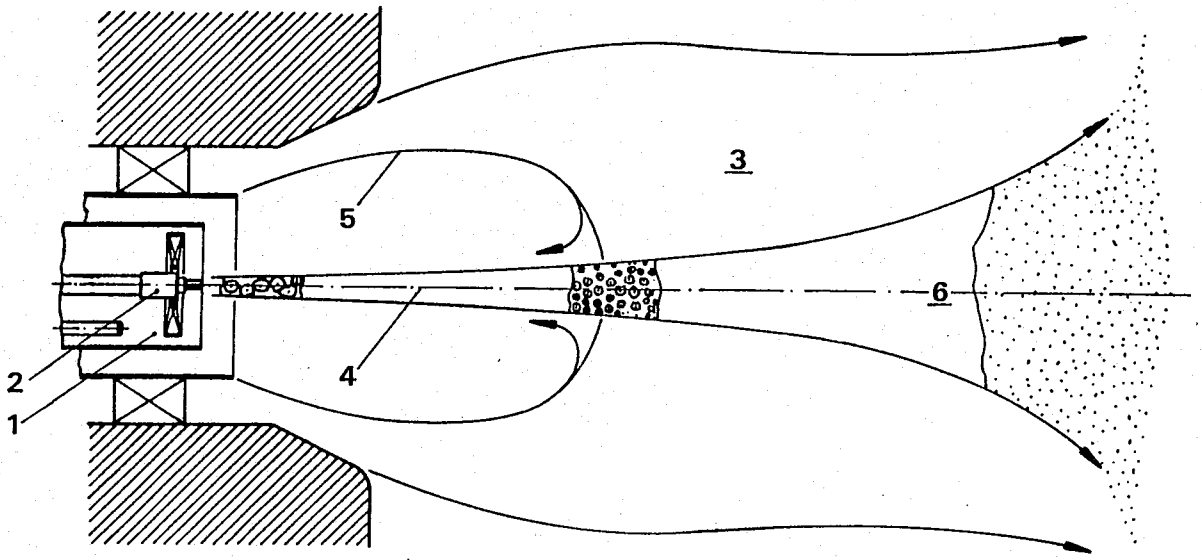
FIG. 1 is a partial longitudinal section through one embodiment of the inventive annular burner, and through the flame formed by the inventive method for burning a liquid fuel or a fuel suspension.
Figure 2:
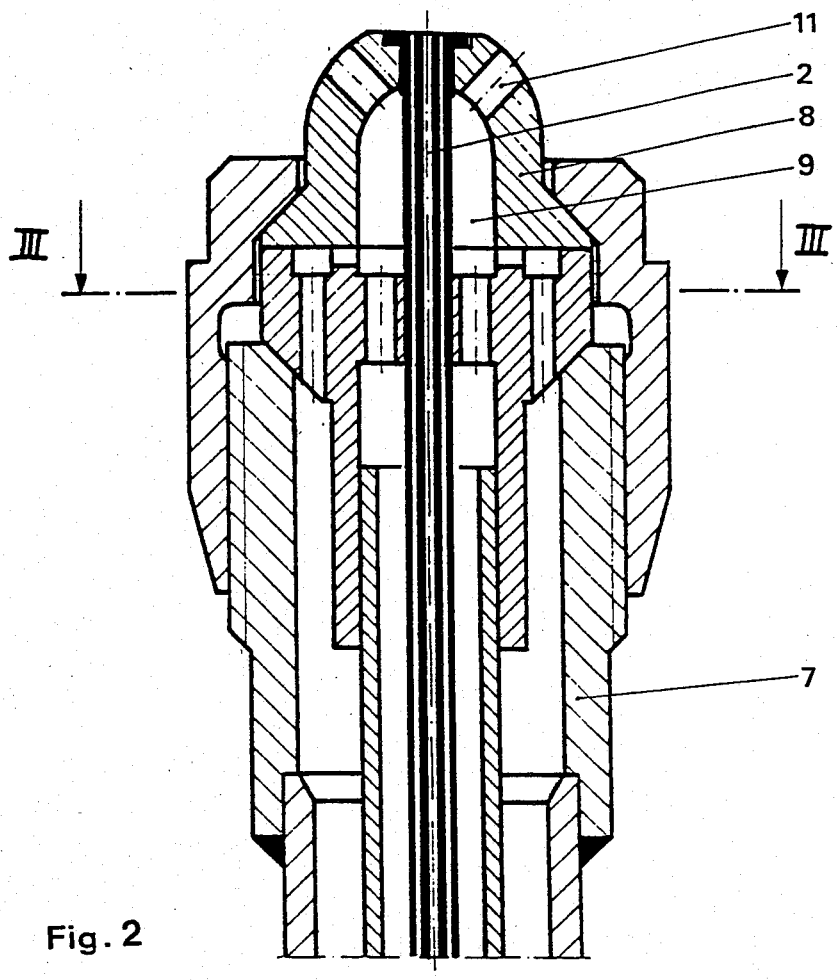
FIG. 2 is a detailed longitudinal section through the front end of the inventive annular burner.
Figure 3:
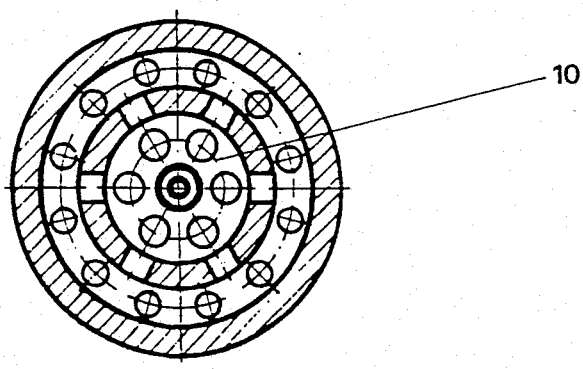
FIG. 3 is a section taken along the line III—III in FIG. 2.

The method of the present invention is characterized primarily in that the additive, via the atomizing nozzle disposed in the central portion of the annular burner, is sprayed as an external mixture, via the atomizing nozzle, along the longitudinal axis of the flame, as a fine or narrow stream, through the internal recirculation zone and into the flame; the flow pulse and the angle of dispersion of the additive suspension stream are selected in such a way that the additive suspension is not atomized until it reaches the optimum reaction region of the flame.

Various additive/water mixtures can be used as the additive suspension, including lime solution, limestone-water suspension, or an aqueous solution or suspension of sodium carbonate.

The flame into which the additive suspension is sprayed can be produced by the combustion of various types of fuels, including liquid fuels such as heating oils and petroleum residues, fuel suspensions such as residues from the hydrogenation processing of crude oil as well as the derivatives therefrom, and coal, with the coal being burned as dry coke dust, coal-water suspension, or coal-oil suspension, and solid fuels having a low ash content, such as petroleum coke.

With the combustion of liquid fuel or a fuel suspension, the fuel and the additive suspension are preferably atomized by means of two different nozzles that are combined on a common nozzle assembly in the central portion of the burner.

However, it may also be advantageous, when liquid fuel or a fuel suspension is burned, to atomize the fuel and the additive suspension by means of two different nozzles that are disposed next to one another in the central portion of the annular burner.

Finally, with the combustion of solid fuel, the fuel can be fed through an annular channel disposed concentrically relative to the additive atomizing nozzle that is disposed in the central portion of the burner.

The annular burner of the present invention is charcterized primarily by fuel feed means for feeding fuel into the flame; an additive atomizer is disposed in the central portion of the fuel feeding means and has nozzle means for effecting spraying of the additive, with the nozzle means of the additive atomizer being disposed in the longitudinal axis of the burner.

When liquid fuel or a fuel suspension is burned, it is expedient to dispose the additive atomizing nozzle, which is/embodied as a two-component nozzle, in the central portion of fuel feed means that is embodied as a two-component nozzle having an internal mixing chamber. Furthermore, for the discharge of the fuel that is mixed with the pertaining atomizing medium, a number of bores are distributed on an imaginary circle, and are inclined at an angle relative to the longitudinal axis of the burner. When solid fuel is burned, on the other hand, it is expedient to surround the additive atomizing nozzle with an annular channel through which the solid fuel is fed.

DESCRIPTION OF PREFERRED EMBODIMENTS

The application of the method of the present invention will now be described in connection with one inventive embodiment of an annular burner used to burn a liquid fuel or a fuel suspension.

The additive suspension is sprayed into the flame 3 via the atomizer 2, which is located in the central portion 1 of the burner. The additive suspension is sprayed-in in such a way that it passes through the internal recirculation zone 5 of the flame 3 as a fine or narrow stream 4. The additive suspension is finally completely finely atomized in that region 6 of the flame that is favorable for the binding reactions; in this region, the additive suspension is mixed with the combustion gases. The atomizer 2 is embodied as a two-component nozzle having external mixing, and is disposed concentric to the longitudinal axis in the fuel atomizer 7 in such a way that the nozzle opening of the atomizer 2 is located in the central portion of the head 8 of the fuel nozzle. The fuel is mixed in the mixing chamber 9 with the pertaining atomizing medium, and is atomized via a number of openings 11 that are inclined at an angle relative to the longitudinal axis and are disposed on an imaginary circle 10.

The proper selection of the flow pulse or momentum and of the angle of dispersion of the additive suspension stream 4 on the one hand prevents impairment of the ignition stability of the flame, and on the other hand prevents possible impairment of the reactivity of the additive due to sintering as a result of a temperature that is too high, with both of these adverse conditions being due to an intermixing of the additive suspension that is too intensive in the internal recirculation zone 5.

The present invention is, of course, in no way restricted to the specific disclosure of the specification and drawings, but also encompasses any modifications within the scope of the appended claims.

What is claimed is:

1. In a method of binding sulfur and other impurities during the combustion of fuels that contain such impurities, where the fuel is burned in an annular burner flame that has an internal recirculation zone, and where an additive in the form of an aqueous suspension is sprayed into the combustion chamber via at least one two-component atomizing nozzle and the additive is mixed with the gases of the flame under optimum reaction conditions, the improvement including the steps of:

disposing an atomizing nozzle for said additive in the central portion of said annular burner;

spraying said additive as an external mixture, via said atomizing nozzle, along the longitudinal axis of said flame, as a narrow stream, through said internal recirculation zone and into said flame; and selecting the flow pulse and the angle of dispersion of said additive suspension stream in such a way that said additive suspension is not atomized until it reaches the optimum reaction region of said flame.

2. A method according to claim 1, which includes the step of selecting said additive suspension from the group consisting of lime solution, limestone-water suspension, an aqueous solution of sodium carbonate, and an aqueous suspension of sodium carbonate.

3. A method according to claim 1, where the method is used for burning liquid fuel or a fuel suspension, and includes the step of atomizing said fuel and said additive suspension with two different nozzle means that are combined on a common nozzle assembly in the central portion of said burner.

4. A method according to claim 1, where the method is used for burning liquid fuel or a fuel suspension, and includes the step of atomizing said fuel and said additive suspension with two separate nozzle means that are disposed next to one another in the central portion of said burner.

5. A method according to claim 1, where the method is used for burning solid fuel, and includes the step of supplying said fuel through an annular channel that is concentric to the additive atomizing nozzle, which is disposed in the central portion of said burner.

6. An annular burner for binding sulfur and other impurities during the combustion of fuel containing such impurities with the fuel being burned in the flame of the burner, with the flame having an internal recirculation zone; an additive in the form of an aqueous suspension being sprayed into the region of said flame via at least one two-material atomizing nozzle; said burner comprising:

a fuel feed means for feeding fuel into the flame; and an additive atomizer disposed in the central portion of said fuel feeding means having an internally located mixing chamber, and having nozzle means for effecting spraying of additive; said nozzle means of said additive atomizer being disposed outwardly inclined and concentrically in a circle relative to a longitudinal axis of said burner.

7. An annular burner according to claim 6, for combustion of liquid fuel or a fuel suspension, said fuel feed means being embodied as a two-material nozzle having an internal mixing chamber, with said additive atomizer being a two-material nozzle disposed in the central portion of said burner; said burner also including as said nozzle means discharge means for fuel mixed with atomizing medium, with said discharge means being a plurality of bores distributed along graduations of said circle and inclined at an angle relative to the longitudinal axis of said burner.

8. An annular burner according to claim 7, for combustion of solid fuel, said fuel feed means being embodied as an annular channel, disposed about said additive atomizing nozzle, for supplying solid fuel.

* * * * *